United States Patent [19]
Dubberly

[11] 4,259,571
[45] Mar. 31, 1981

[54] APPARATUS AND METHOD FOR CONTAINER RECOGNITION

[75] Inventor: Gregory T. Dubberly, Atlanta, Ga.

[73] Assignee: The Mead Corporation, Dayton, Ohio

[21] Appl. No.: 42,468

[22] Filed: May 25, 1979

[51] Int. Cl.[3] ..... B07C 5/10; G06M 7/00
[52] U.S. Cl. ..... 250/223 B; 209/524; 209/529; 235/92 PK
[58] Field of Search ..... 250/223 R, 223 B; 209/524, 525, 529, 586, 564; 235/92 V, 92 PK; 356/240

[56] References Cited

U.S. PATENT DOCUMENTS

| | | | |
|---|---|---|---|
| 3,365,699 | 1/1968 | Foster | 250/223 R |
| 3,837,486 | 9/1974 | Gardner | 209/586 X |
| 3,955,179 | 5/1976 | Planke | 250/223 B X |
| 4,166,949 | 9/1979 | Pold | 250/223 B |

*Primary Examiner*—David C. Nelms
*Assistant Examiner*—Edward P. Westin
*Attorney, Agent, or Firm*—Biebel, French & Nauman

[57] ABSTRACT

Apparatus and method for observing containers which are transported through an illumination station, and generating a recognition signal on the basis of leading edge scanning information. Leading edge scanning information is produced by a trigger photodetector and a plurality of vertically arranged registration photodetectors. A container which is to be recognized is carried through the illumination station by a conveyor, and the conveyor generates conveyor clock pulses corresponding to actual movement of the container through the illumination station. The trigger photodetector senses the leading edge of the container, and it generates a trigger signal which enables a counter to begin counting conveyor clock pulses. The registration photodetectors are positioned downstream from the trigger photodetector and are connected for terminating the counting of conveyor clock pulses upon detection of the container leading edge at their respective positions.

There is also disclosure of a vertically progressing arrangement of height detecting photodetectors positioned above and upstream from the trigger photodetector. The height detecting photodetectors perform a height classification at the instant of activation of the trigger photodetector. The system includes a plurality of recognition circuits for recognizing different classes of containers, and the height classification is used for selecting those recognition circuits to be employed for recognition of the particular container being observed.

16 Claims, 8 Drawing Figures

APPARATUS AND METHOD FOR CONTAINER RECOGNITION

BACKGROUND OF THE INVENTION

This invention relates to the reception, handling and evaluation of empty beverage containers. Systems for performing such functions have particular applicability to a supermarket environment, where large numbers of returnable beverage containers must be redeemed for their deposit values. Prior art systems of this general type are disclosed in Planke U.S. Pat. No. 3,955,179, Planke U.S. Pat. No. 4,055,834, and in Dubberly et al U.S. patent application Ser. No. 924,855.

As disclosed in Planke U.S. Pat. No. 3,955,179, a container is recognized by transporting it through an illumination station, where it is illuminated by a large beam of light. A shadow of the container is projected against a screen and is detected by a series of photodetectors which are strategically mounted within the screen. Output signals from the photodetectors are applied to evaluation circuitry, which recognizes the container and generates a signal representing the deposit value thereof. The system totals the deposit values for a series of containers which are so recognized and prints a redemption ticket indicating the computed total value.

Planke U.S. Pat. No. 4,055,834 discloses a container recognition system wherein the container is transported through the path of a vertically sweeping laser beam. A bundle of optical fibers is arranged to receive signals from the sweeping laser along a series of vertically arranged points. The fibers are arranged to carry light from their receiving ends to the face of a photodetecting device. The photodetecting device then generates an electrical signal which represents the contour of the container. Means are provided for processing this signal to recognize the container and print a redemption ticket.

Dubberly et al teaches a container recognition system wherein the container is placed upon a conveyor equipped with an encoder device. The movement of the conveyor causes the encoder to generate a series of conveyor clock pulses representing actual physical movement of the container. The container is transported through an illumination station where it blocks the light falling upon a series of vertically arranged photodetectors. When the leading edge of the container first blocks any photodetector, that photodetector generates a light-to-dark transition signal, which causes a series of associated counters to begin counting conveyor clock pulses. These counters count to predetermined minimum counts at which time they open registration "windows" by enabling associated registration circuits. The counters then continue counting to predetermined maximum counts, during which counting the registration circuits are operative to produce container recognition signals.

According to the Dubberly et al teaching, the photodetectors remain operative throughout the time period of the registration window and continually look for the trailing edge of the container. When the trailing edge of the container comes into view the photodetectors sense a dark-to-light transition. This dark-to-light transition causes generation of trailing edge signals. The trailing edge signals are applied to those registration devices which are associated with the signal generating photodetectors. If a registration device receives such a trailing edge signal while it is enabled, then a container recognition signal is generated. When the counters reach their predetermined maximum counts, they close their registration windows by disabling their associated registration circuits.

It has been observed that when some types of glass bottles are being illuminated as taught in Dubberly et al, the background is completely darkened. During the time that the photodetectors are being blocked from the illumination source they sometimes see bright spots due to reflection of light within the structure of such glass bottles. In fact, some bottles may create bright spots which are even brighter than the unblocked illumination source itself.

When the photodetectors see a bright spot within a container, they are likely to interpret the spot as the trailing edge of the container. Such an interpretation causes application of a trailing edge signal to all registration circuits which are connected to the spot-observing photodetector. Any such registration circuits which are enabled at that time will generate an erroneous recognition signal.

SUMMARY OF THE INVENTION

The present invention relates to an improved container recognition system which avoids problems due to bright spots on containers. The apparatus and method of this invention avoid such problems by recognizing a container only on the basis of the leading edge profile. The apparatus of this invention transports containers through an illumination station while generating a movement indicating signal. Trigger means are provided for initiating counting of variations in the movement indicating signal, which occur after the leading edge of the container passes a predetermined point in space. The counting continues until another point along the leading edge of the container passes a different predetermined point in space. The count between the different observations of the two leading edge contour points is used as a measure of the horizontal distance between those points.

In accordance with this invention the container recognition system never looks for a trailing edge contour. Furthermore, in accordance with this invention container recognition counting begins with the first observation of a light-to-dark transition at one elevation and it terminates with the first observation of a light-to-dark transition at a different elevation. Thus there is no chance of confusion by a bright spot within the interior of a container.

When a system recognizes a container based only upon leading edge information, it is working with considerably less information than is available when the entire container or the entire container outline is observed. This increases the difficulty in discriminating between certain classes of containers. Accordingly, in accordance with a preferred embodiment of the invention, the trigger signal is generated by a trigger cell located up stream from a vertically progressing line of registration photodetectors, which function as leading edge contour sensors. An arrangement of vertically progressing height detecting photodetectors are positioned above and upstream from the trigger photodetector. The height detecting photodetectors are so arranged as to sense a height range for the container at the instant when the leading edge of the container passes the trigger photodetector. The output from the height detecting photodetectors is used for selecting a relatively few container recognition circuits from among a number of such circuits incorporated within the system. This decreases the chance of mistaking one type of container for another.

The apparatus and method of this invention may be used in combination with a system as disclosed in Ser. No. 924,855. In such a combination individual containers are recognized in accordance with this invention, while containers within cartons are recognized as taught in Ser. No. 924,855. A single arrangement of photodetectors operates in either mode, so that a mixed group of single containers and container filled cartons may be efficiently processed.

DESCRIPTION OF THE PREFERRED EMBODIMENT

Figures 1, 2:
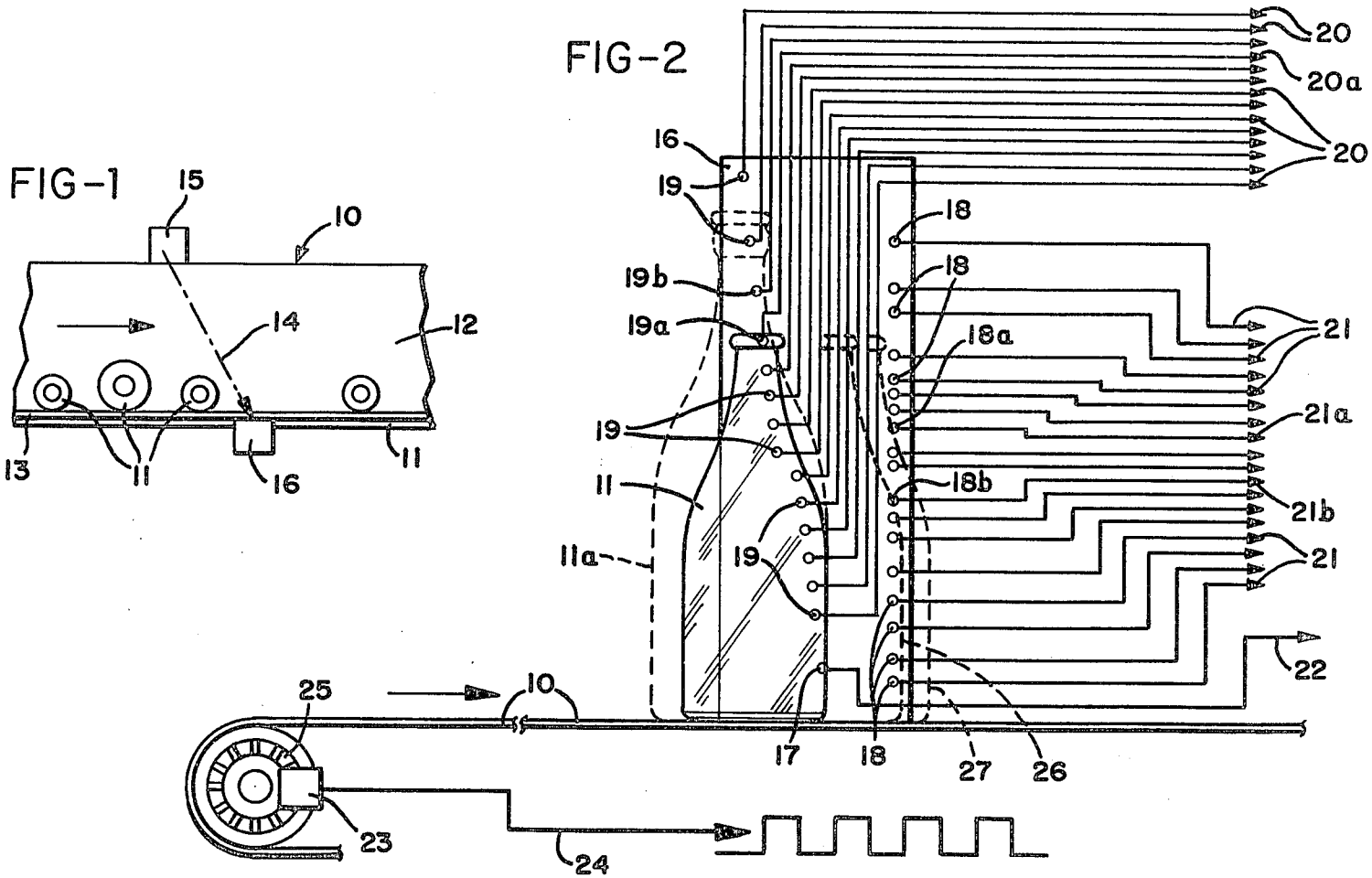
FIG. 1 is a top plan view of a container observation station.
FIG. 2 is a schematic side elevation view of a container during passage through a container observation station.

In preferred embodiment a series of containers 11 are transported through an observation station 10 as illustrated in FIG. 1. Containers 11 are carried by a conveyor 12 and are aligned in space progression against a side board 13. Preferred apparatus for aligning containers 11 against sideboard 13 is disclosed in U.S. patent application Ser. No. 042,469 filed on even date herewith and assigned to the assignee hereof.

In the general case, conveyor 12 may carry containers grouped in carrying cartons, as well as individual containers as illustrated. It has been found that containers positioned within cartons are best recognized as taught in Ser. No. 924,885, and reference may be made to that application for a description of such container recognition apparatus. The scanning system of this invention is adapted to observe containers either individually or in cartons and to apply sensing signals to the appropriate recognition circuitry. Other apparatus (not illustrated) detects the approach of a carton and conditions the system to employ recognition circuitry appropriate to cartons.

As containers 11 pass through observation station 10, they interrupt a light beam 14, which is generated by an illuminator 15. Illuminator 15 may generate a series of narrow light beams or a single relatively large beam of colliminated light. For the present purposes, light beam 14 may be considered to be a single beam of light of sufficient size for illuminating all of the active area of a scanner 16.

Figure 4A:
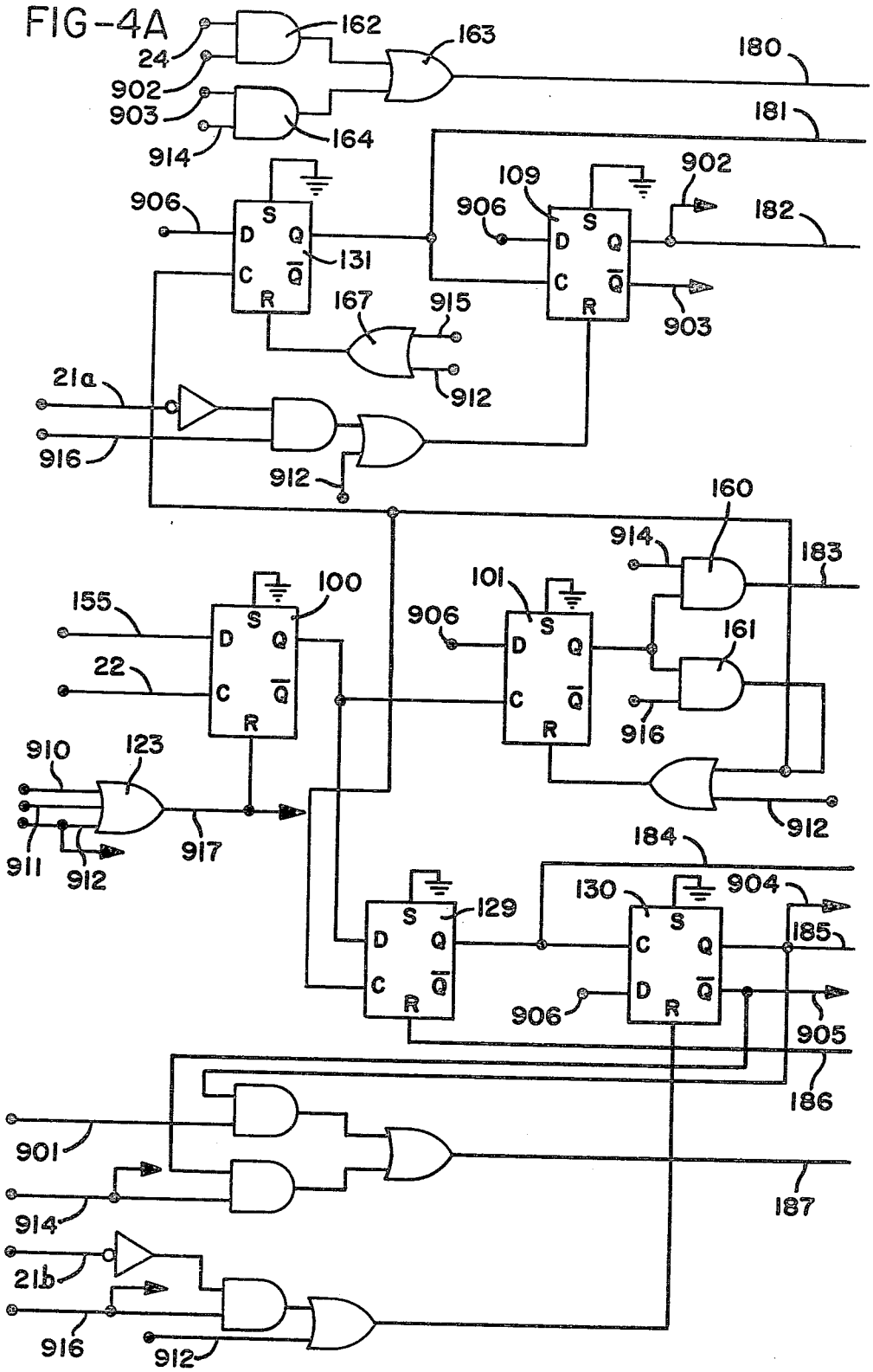
FIGS. 4*a* through 4*c* are a schematic illustration of a container recognition circuit.
Figure 4B:
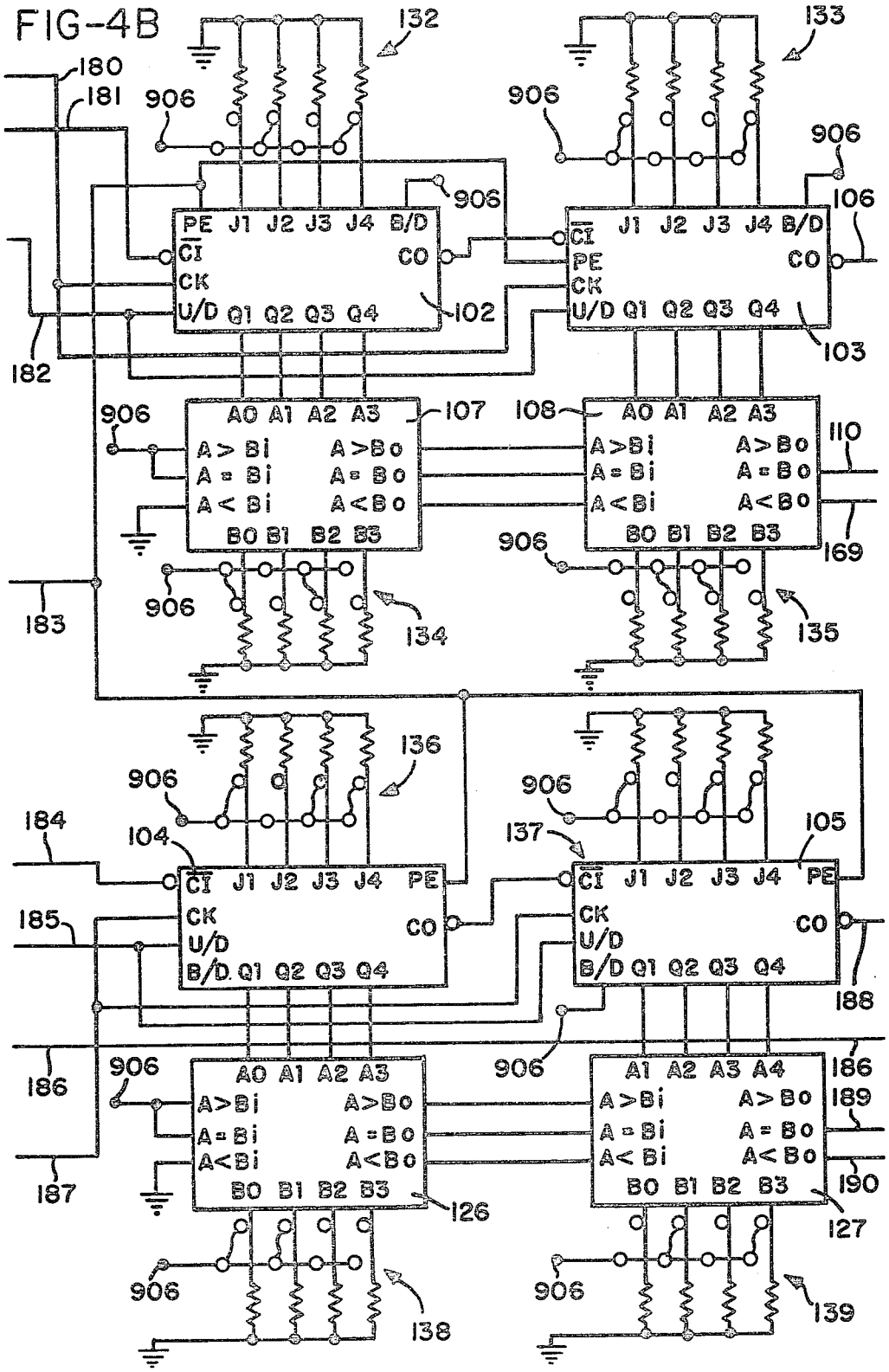
Figure 4C:
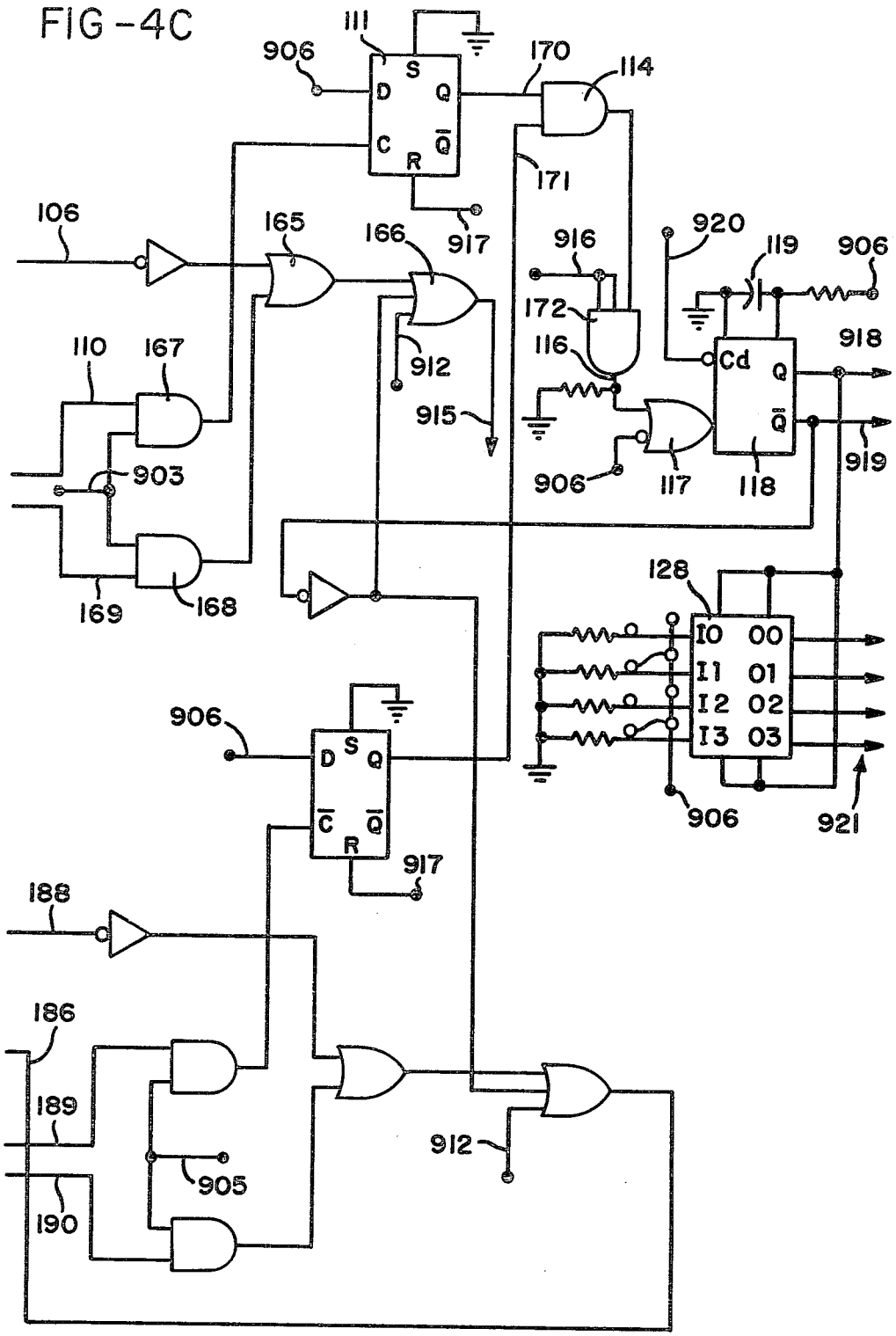

As best illustrated in FIG. 2, the face of scanner 16 which faces containers 11 is provided with a trigger photodetector 17, a plurality of registration photodetectors 18 and a plurality of height detecting photodetectors 19. Height detecting photodetectors 19 are connected to a series of lead lines 20, while registration photodetectors 18 are connected to a series of lead lines 21. Trigger photodetector 17 is connected to a lead line 22. Lead lines 20, 21, and 22 are connected to a series of recognition circuits as illustrated in FIGS. 4*a* through 4*c*.

The system also includes an encoder 23, as illustrated generally in FIG. 2. Encoder 23 has an output line 24, which carries a series of conveyor clock pulses. These clock pulses are produced by rotation of an encoding disc 25 and provide a very accurate representation of actual physical movement of container 11.

As container 11 progresses through the observation station, the leading edge thereof progresses to a series of positions, two of which are indicated schematically by dotted lines 26 and 27. This causes production of light-to-dark leading edge transition signals, as hereinafter described with reference to FIG. 3. The method of container recognition by leading edge detection is described with reference to FIG. 6.

Figure 6:
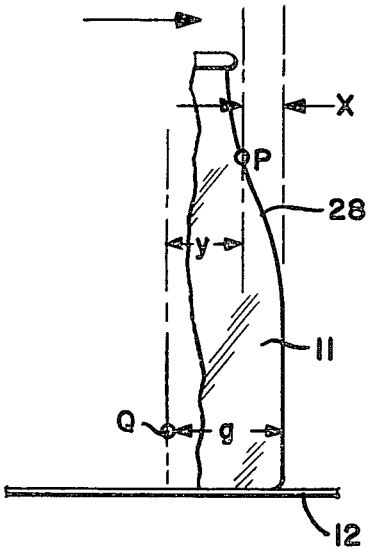
FIG. 6 is a diagramatic illustration of a typical container leading edge.

FIG. 6 illustrates a leading edge 28 of a container 11 being horizontally transported by conveyor 12. The point Q represents the location of trigger cell 17, and the point P represents the location of one of the registration photodetectors 18. As illustrated in FIG. 6, container 11 has reached a recognition position (e.g. one of the positions indicated by dotted lines 26 and 27 of FIG. 2) at which leading edge 28 is passing in front of point P. Container 11 has therefore traveled a total distance g since the instant when the trigger cell was crossed by leading edge 28. The distance x is the horizontal distance between that point on leading edge 28 which is at the height of the trigger cell and another point on leading edge 28 which has the same height as the point P. This distance is a unique characteristic of container 11 and is used for container recognition.

The system establishes the distance x by measuring the distance g and subtracting the distance y. Y is merely the known horizontal distance between points Q and P, while the distance g is determined by counting conveyor clock pulses.

Figure 3:
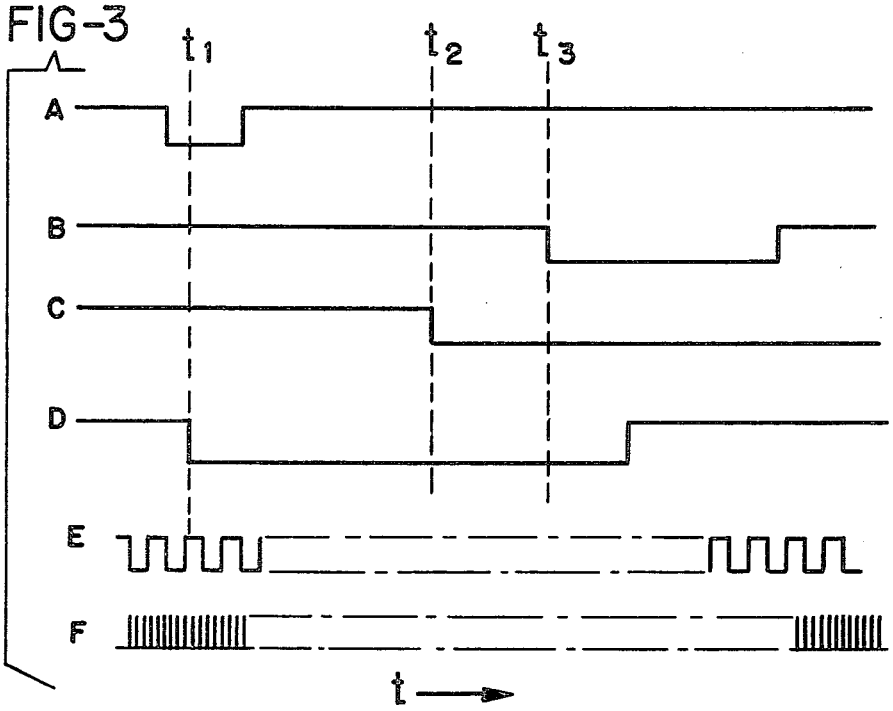
FIG. 3 is a timing diagram illustrating the generation of leading edge transition signals.

FIG. 3 illustrates the time sequence of the various signals associated with the container recognition sequence. The signal A represents the signal generated on Line 20*a* by height detecting photodetector 19*a*. Signals B and C represent signals on lines 21*a* and 21*b* which are generated respectively by registration photodetectors 18*a* and 18*b*. Signal D is the signal on line 22 from trigger photodetector 17. Signal E is the conveyor clock signal on line 24, and line F is a crystal controlled system clock signal, which has a frequency considerably higher than the nominal frequency of occurrence of conveyor clock pulses. As indicated at time $t_1$, trigger signal D undergoes a light-to-dark transition due to the passage of the container leading edge across the point Q. At this time signal A is indicating a dark condition for height detecting photodetector 19*a*, which operates as hereinafter described for enabling container recognition by a predetermined set of recognition circuits.

When the signal D indicates a light-to-dark transition, then the system begins counting conveyor clock pulses (Signal E) and continues counting until time $t_2$, when signal C indicates observation of a light-to-dark transition by registration photodetector 18*b*. That count is compared against a predetermined range of counts in order to determine whether or not a recognition should be generated. In the preferred embodiment of the invention there is another counter which continues counting past time $t_2$ until time $t_3$, when signal B indicates detection of light-to-dark transition by registration photodetector 18*a*.

If a registration photodetector 18 reaches a count N at the time of counting termination, then the distance g is known from the relation:

$$g=N\delta$$

where $\delta$ represents the amount of conveyor movement during the period of one conveyor clock pulse.

This uniquely determines x from the relationship:

$$x=N\delta-y$$

The system is so designed as to generate a container recognition only under the condition:

$$x_{min}<x<x_{max}$$

where $x_{min}$ is a minimum permissible value of x corresponding to a lower limit count $N_{min}$ and $x_{max}$ is a maximum permissible value of x corresponding to an upper limit count $N_{max}$. The counts $N_{min}$ and $N_{max}$ are established on the basis of experience with different bottle types, and recognition is indicated when the system makes a count N fulfilling the conditions:

$$N_{min}<N<N_{max}$$

Recognition of $N_{max}$ is accomplished as follows:

The system has a counter which overflows at a count of $2^8$ and which is preset with the number $N_p$ where $N_p$ is defined by the relationship:

$$N_p=2^8-N_{max}$$

Due to this preset, the actual count within the counter is $N+N_p$.

Once counting has been initiated by the trigger cell, the counter adds a new count for each new conveyor clock pulse. This counting continues until either terminated by a leading edge pulse from one of the registration photodetectors or until a $2^8$ overflow count is reached. If the overflow condition is reached then the system knows that:

$$N+N_p=2^8$$

and therefore, $$N=N_{max}$$

consequently a first type of out-of-range signal is generated.

If a light-to-dark transition signal is gated into the recognition circuit before the overflow condition is reached, then the count within the counter is applied to a comparator which compares the count with a preset comparison count, $N_c$, which has been selected according to the relation:

$$N_c=N_p+N_{min}$$

In the event that the observed count $N+N_p$ satisfies the condition:

$$N+N_p<N_c$$

then the system knows that $$N<N_{min}$$

and a second type of out-of-range signal is generated.

If the second type of out-of-range condition is not indicated, then the counter is controlled to count rapidly downward until the comparator recognizes the condition:

$$N+N_p=N_c$$

Such a successful downward count is an indication of a value of x within the predetermined range. The system therefore generates a recognition signal upon completion of such a downward count.

Figure 5:
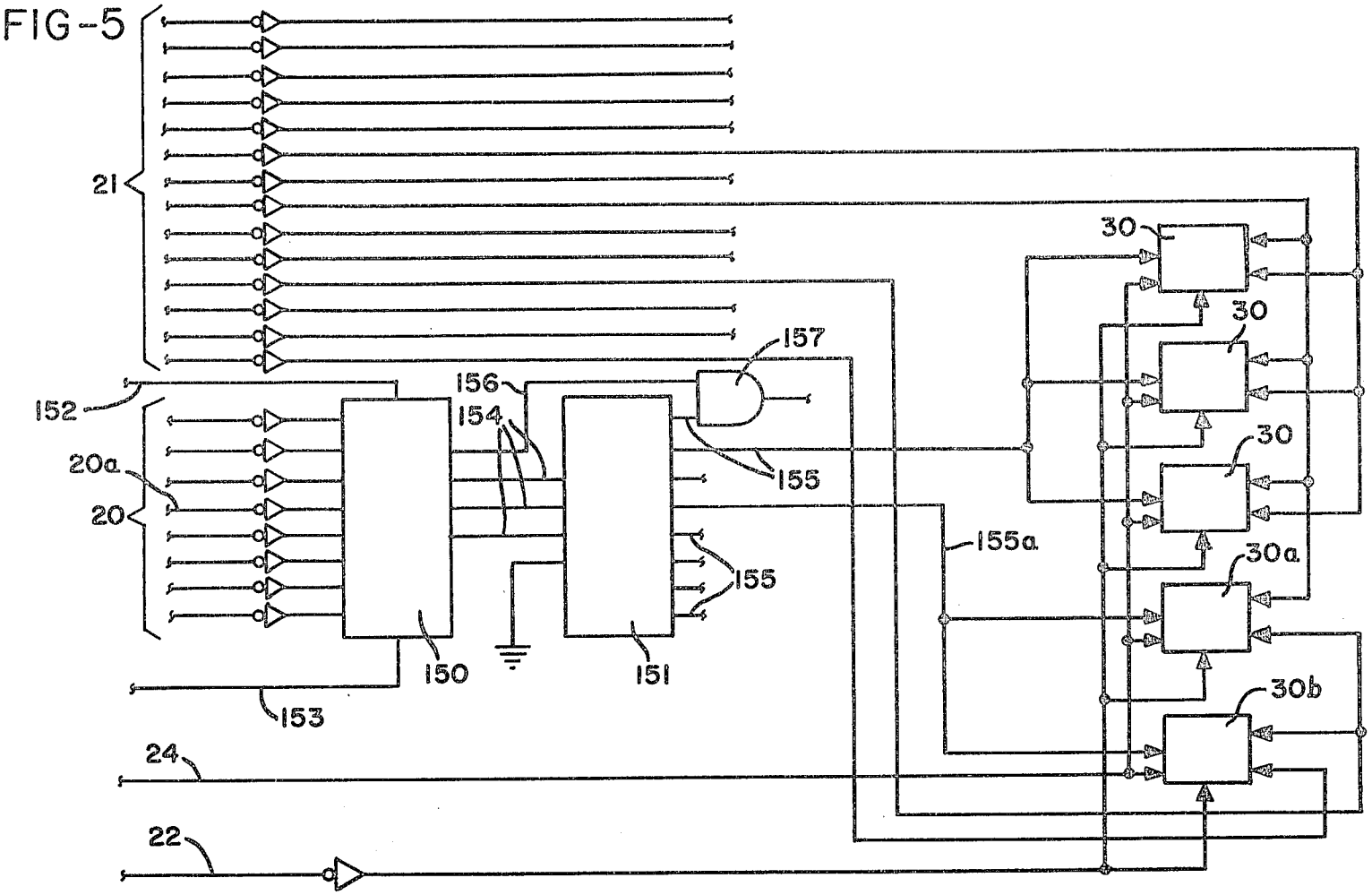
FIG. 5 is a schematic illustration of circuitry for selectively enabling container recognition circuits.

Reference now is made FIGS. 4*a* through 4*c* and FIG. 5, which illustrate apparatus for receiving container scanning information and generating a recognition signal. FIG. 5 is a generalized system block diagram, while FIGS. 4*a* through 4*b* present a schematic diagram of a recognition circuit. FIGS. 4*a* through 4*c* and 5 include schematic representations of a number of standard integrated circuits. Table I identifies the various circuit types which are so illustrated.

The recognition circuit illustrated in FIGS. 4*a* through 4*c* is one of a number of recognition circuits, which may be employed for recognizing different containers. The block diagram of FIG. 5 includes five such recognition circuits 30. Each recognition circuit 30 is connected for reception of signals from two of the lines 21. As described above, lines 21 are connected to registration photodetectors 18. Recognition circuits 30 are also connected to line 22 for reception of a trigger signal and to line 24 for reception of conveyor clock pulse.

Each recognition circuit 30 is operative for counting conveyor clock pulses which occur on line 24 subsequent to the appearance of a signal on line 22. Each recognition circuit has a pair of counting chains for performing two simultaneous counts. These two counts are terminated by leading edge transition signals appearing on the two lines 21 to which the recognition circuit is connected. It should be understood that such dual counting is a mere matter of convenience and that a recognition circuit 30 requires connection to only one of the lines 21.

As mentioned previously, not all recognition circuits are activated for recognition of a particular container. Thus there are provided a priority encoder 150 and a decoder 151 for selecting recognition circuits in accordance with signals appearing on lines 20. FIG. 5 illustrates 8 lines 20, while 14 such lines are illustrated in FIG. 2. The remaining 6 lines are connected to an additional priority encoder and decoder arrangement (not illustrated). Priority encoder 150 has an enabling input line 152 and an enabling output line 153. As illustrated in FIG. 5, priority encoder 150 is connected to the group of lines 20 which carries signals from the 8 highest level height detecting photodetectors 19. Thus line 153 carries on enabling output signal from priority encoder 150 to the enabling input terminal of the other priority encoder. The illustrated priority encoder 150 is enabled by connecting line 152 to a constant voltage source.

Referring now to FIG. 2, it will be observed that container 11 blocks the view of 11 height detecting photodetectors, the highest one of which is indicated at 19*a*. Photodetector 19*a* is positioned so as to be observed by the upper portion of container 11 at the instant when the leading edge of the container passes a trigger photodetector 17. At that time photodetector 19*a* is darkened and has a dark signal output. In general the height detecting photodetectors below photodetector 19*a* also are darkened at that time, but some of them may be viewing light spots. As a rule glass containers do not have light spots at the top, so it may be assumed that a container having the configuration of container 11 will always darken photodetector 19*a* at the time of trigger signal generation. Thus if photodetector 19*a* is the highest darkened light detecting photodetector at that time, it is known that container 11 has a height at least as high as photodetector 19*a* and less than the height of the next higher photodetector 19*b*. This provides a criterion for selectively activating a relatively small group of recognition circuits 30.

Priority encoder 150 has three output lines 154, which carry a digital code indicating the highest one of the lines 20 which carries a dark indicating signal. Decoder 151 decodes the signal appearing on lines 154 and provides an output enabling signal on one of eight output lines 155. In the special case where line 20*a* happens to be the highest dark indicating line, then line 155*a* may be the activated output line from decoder 151. As illustrated in FIG. 5 line 155*a* may enable two recognition circuits 30*a* and 30*b*.

In the special case where the highest height detecting photodetector 19 is darkened, then the digital code on lines 154 is indeterminate. This is resolved by providing a special signal output from priority encoder 150 on line 156. Line 156 enables AND gate 157, and the output from the AND gate 157 is used for activation of appropriately predetermined recognition circuits.

It has been found that a downwardly sloping line of height detecting photodetectors 19, as illustrated in FIG. 2, will satisfactorily perform a height classification function for nearly all returnable beverage containers currently in use within the United States. FIG. 2 illustrates a container 11*a* in dotted lines to indicate the geometry of a height classification problem for a somewhat larger container than that which was described above.

Specific apparatus and method for generation of a container recognition signal will now be described with reference to FIGS. 4*a* through 4*c*. These figures collectively define a recognition circuit of 30, and common reference numerals are applied to all lines which are commonly connected. Table II lists some of the signals appearing on various lines illustrated in the figures.

As previously stated, the recognition circuit is enabled by an enabling signal on line 155. This signal is applied to the D terminal of a flip-flop 100, which enables the flip-flop to be set by application of a trigger signal to line 22. Setting of flip-flop 100 then causes the previously described preset count $N_p$ count to be set into the counter chains. The two counter chains are separately conditioned by generation of container recognition signals, and the following discussion describes the operation of one of the chains in detail.

The chain which will be described comprises a first counter 102 which is connected in cascade fashion with a second counter 103. The two counters may be thought of as being a single counter, which functions in the general manner previously described. Thus the preset count $N_p$ is set into counters 102 and 103 by making appropriate connections within a pair of resistor networks 132 and 133. The comparison of the count within the counters against a comparison count $N_c$ is performed by a pair of cascaded comparators 107 and 108. The comparison count is set into comparators 107 and 108 by appropriate connections within a pair of resistor networks 134 and 135.

When the recognition circuit has been enabled by setting of flip-flop 100, then a pair of AND gates 160 and 161 are enabled by flip-flop 101. Enabling of AND gate 160 causes the preset count to be read into counters 102 and 103, and enabling of AND gate 161 sets flip-flop 131. Setting of flip-flop 131 enables counting by counters 102 and 103 and also sets flip-flop 109 to cause upwardly directed counting by the counters. When flip-flop 109 is set, a HI output on line 902 enables AND gate 162 for passage of conveyor clock pulses from line 24. These conveyor clock pulses are applied through OR gate 163 to the clock terminals of counters 102 and 103.

If counters 102 and 103 reach an overflow $2^8$ count, then an upper limit out-of-range signal appears on line 106 for passage through OR gates 165 and 166 to line 915. Line 915 is connected to the input side of OR gate 915, so that the out-of-range signal resets flip-flop 131 and terminates counting by the counting chain.

When a container leading edge signal appears on line 21*a*, flip-flop 109 is reset, thereby causing downward counting by counters 102 and 103, disabling of AND gate 162, enabling of AND gate 164, and enabling of AND gates 167 and 168. When AND gate 168 is enabled, the system is conditioned to respond to a lower limit out-of-range signal on line 169. Such an out-of-range signal will be present when comparators 107 and 108 detect a count lower than $N_c$, as above described. This condition produces a reset signal for flip-flop 131 in like manner as the upper limit out-of-range signal on line 106.

If comparators 107 and 108 do not detect a lower limit out-of-range condition, then counters 102 and 103 begin rapid downward counting of system clock pulses appearing on lines 914 and gated through AND gate 164. Downward counting proceeds until comparators 107 and 108 detect a count equal to $N_c$. When this condition is sensed, an output appears on line 110 for gating through AND gate 167 and setting of flip-flop 111. A resulting HI signal on line 170 indicates that the system has recognized the container.

As previously discussed, the system preferably bases container recognition upon successful generation of two independent recognition signals. Thus the second counter chain comprising counters 104 and 105 is operated to produce a similar but independent recognition signal on line 171. The second counter chain has its own resistor networks 136 and 137 and a pair of comparators 126 and 127. Comparators 126 and 127 have resistor networks 138 and 139 for indication of a preset count $N_c$ appropriate for evaluation of a leading edge transition signal appearing on line 21*b*. Resistor networks 136 and 137 indicate the corresponding appropriate preset count $N_p$.

When recognition signals appear on both of lines 170 and 171, then AND gate 114 enables another AND gate 172, so that the inverse system clock signal appearing on line 916 provides a trigger signal for monostable multivibrator 118. Monostable 118 then is triggered for a predetermined period of time as determined by R-C network 119. Triggering of monostable 118 produces a HI signal on line 918 for application to address generator 128. Address generator 128 has a preset input, which is transferred onto output lines 921 when monostable 118 is triggered. The code which is so transferred onto lines 921 represents the deposit value of the container which has been recognized. This deposit value code is transmitted to other circuitry (not illustrated) which totals a series of such codes and controls the printing of a refund ticket.

Triggering of monostable 118 also produces a LO signal on line 919, which resets both counting chains. Line 919 is interconnected with similar lines on other recognition circuits, so that generation of a container recognition signal by any recognition circuit resets the counting chains in all recognition circuits.

Resetting of flip-flop 100 is accomplished by an output signal from OR gate 122, after the container has cleared the line of registration photodetectors. It has been found that the bottom photodetector has a reliably dark indication while the container is preset. A dark-to-light transition from this photodetector appears on line 910 for application to the reset terminal of flip-flop 100. Flip-flop 100 likewise is reset by signal from the carton recognition circuitry on line 911 or a master clear signal on line 912.

While the method herein described, and the form of apparatus for carrying this method into effect, constitute preferred embodiments of the invention, it is to be understood that the invention is not limited to this precise method and form of apparatus, and that changes may be made in either without departing from the scope of the invention.

TABLE I

| REF. NUMERAL | CIRCUIT TYPE | FUNCTION |
|---|---|---|
| 100 | 4013 | F/F |
| 101 | 4013 | F/F |
| 102 | 4029 | Counter |
| 103 | 4029 | Counter |
| 104 | 4029 | Counter |
| 105 | 4029 | Counter |
| 107 | 4585 | Comparator |
| 108 | 4585 | Comparator |
| 109 | 4013 | F/F |
| 111 | 4013 | F/F |
| 113 | 4013 | F/F |
| 118 | 4528 | Monostable Multivibrator |
| 126 | 4585 | Comparator |
| 127 | 4585 | Comparator |
| 128 | 4016 | Address Generator |
| 129 | 4013 | F/F |
| 130 | 4013 | F/F |
| 131 | 4013 | F/F |
| 150 | 4532 | Priority Encoder |
| 151 | 4028 | Decoder |

TABLE II

| Signal | Line No. | Function |
|---|---|---|
| CONVEYOR CK | 24 | Conveyor Clock Signal |
| UP 1 | 902 | Up Count Control For Counter #1 |
| DOWN 1 | 903 | Down Count Control For Counter #1 |
| UP 2 | 904 | Up Count Control For Counter #2 |
| DOWN 2 | 905 | Down Count Control For Counter #2 |
| $V_{DD}$ | 906 | Constant Voltage Source |
| CELL | 21a | Leading Edge Signal For Counter #1 |
| BCP | 910 | Enabling Dark Signal From Lowermost Registration Photodetector |
| $\overline{\text{SINGLE/CARTON}}$ | 911 | Indicating Signal For Carton |
| MC | 912 | Master Clear |
| CELL | 21b | Leading Edge Signal For Counter #2 |
| MCKA | 914 | System Clock |

TABLE II-continued

| Signal | Line No. | Function |
|---|---|---|
| CHAIN CL | 915 | Counter Clear (Counter #1) |
| $\overline{\text{MCKA}}$ | 916 | Inverse System Clock |
| RR | 917 | Registration Reset |
| REG | 918 | Recognition Signal |
| $\overline{\text{REG}}$ | 919 | Inverse Recognition Signal |
| ON OK | 920 | Power On Enabling Signal |
| $A_0$, $A_1$, $A_2$, $A_3$ | 921 | 4-Bit Value Address |

What is claimed is:

1. Apparatus for recognizing a container comprising: radiation means for generating a beam of radiation, detecting means for detecting said beam of radiation and generating a detection signal in response to observed variations therein, transport means for transporting said container along a path which interrupts said beam of radiation, movement sensing means for sensing movement of said container and generating a movement indicating signal which varies in correspondence with the sensed movement of said container, trigger means for generating a trigger signal when the leading edge of said container passes a predetermined point in space, recognition means connected to said movement sensing means, said trigger means, and said detecting means for counting variations in said movement indicating signal which occur subsequent to occurrence of said trigger signal and generating a recognition signal when said detection signal occurs within a predetermined range of said counting; characterized in that said recognition means responds only to a detection signal representing a light-to-dark transition detection by said detecting means.

2. Apparatus according to claim 1 characterized in that said trigger means comprises a photodetector positioned for viewing said radiation at a point upstream from the aforementioned detecting means.

3. Apparatus according to claim 2 characterized in that said apparatus further comprises a vertically progressing arrangement of height detecting photodetectors positioned for viewing said radiation at points above and upstream from said trigger photodetector, and height classification means for permitting said recognition means to generate said recognition signal upon observations made by said height detecting photodetectors.

4. Apparatus according to claim 3 characterized in that said recognition means comprises a plurality of different counting circuits preset with predetermined different counts and connected for selection by said height classification means.

5. Apparatus according to any of claims 1 through 4 characterized in that said recognition means comprises means for causing said counting to be terminated upon occurrence of said detection signal, means for reading the count at the time of said termination, and means for comparing said count against preset maximum and minimum values.

6. Apparatus for recognizing a container comprising: means defining an observation station, conveyor means for transporting said container along a path extending horizontally through said observation station, illumination means for directing illumination across said observation station at a level for illuminating said container during passage therethrough, a trigger photodetector positioned at one side of said observation station for detecting said illumination and generating a trigger signal when said illumination becomes blocked by the leading edge of said container, a plurality of registration photodetectors positioned alongside said observation station at points downstream from said trigger photodetector and arranged in vertical progression for viewing said illumination at different levels and generating light-to-dark transition signals when the leading edge of said container blocks said illumination at said different levels, conveyor clock means for sensing the movement of said conveyor and generating conveyor clock pulses representing actual movement of said container through said observation station, and recognition means, including counting means, for counting conveyor clock pulses which occur subsequent to the generation of said trigger signal and generating a recognition signal if the count within said counting means is within a predetermined range at the time of generation of a light-to-dark transition signal by a predetermined one of said registration photodetectors.

7. Apparatus according to claim 6 wherein said recognition means comprises preset means for presetting a maximum permissible count into said counting means, means for generating an out-of-range signal when said maximum permissible count is reached, means for causing reverse counting of said counting means upon generation of a light-to-dark transition signal by said predetermined one of said registration photodetectors, comparing means for reading the count in said counting means during said reverse counting and comparing said count with a predetermined minimum permissible count, and means responsive to said comparing means for generating said recognition signal when said reverse counting successfully reaches said predetermined minimum count.

8. Apparatus according to claim 7 wherein said counting means comprises a counter which overflows at said maximum permissible count.

9. Apparatus according to claim 8 wherein said comparing means comprises means for generating an out-of-range signal when said count is less than said predetermined minimum count at any time after generation of a light-to-dark transition signal by said predetermined one of said registration photodetectors.

10. Apparatus according to any of claims 6 through 9 wherein said recognition means generates a recognition signal only if a plurality of said registration photodetectors generate light-to-dark transition signals during predetermined counting ranges separately associated with each of said registration photodetectors.

11. Apparatus according to any of claims 6 through 9 wherein said apparatus comprises a plurality of said recognition means, and height classification means for activating predetermined ones of said recognition means in accordance with the height of said container.

12. Apparatus according to claim 11 wherein said height classification means comprises a vertically progressing and backwardly sloping arrangement of height detecting photodetectors positioned for viewing said illumination at points above and upstream from said trigger photodetectors, and a priority encoder for identifying the highest one of said height detecting photodetectors which is darkened at the time of activation of said trigger photodetector; said priority encoder effecting said activation in accordance with said identification.

13. The method of recognizing a container comprising the steps of:

(1) transporting said container along a generally horizontal path, (2) sensing the approach of the leading edge of said container at two different elevations along said path and generating transition signals when the leading edge passes predetermined points at said elevations, (3) sensing the horizontal movement of said container during the time between generation of said transition signals, (4) using said horizontal movement as a measure of the horizontal distance between the points of said leading edge which are located at said elevations, and (5) indicating a recognition if the horizontal measure, so determined, is within a predetermined range.

14. A method according to claim 13 wherein said horizontal movement is sensed by generating clock pulses in synchronism with the movement of said container and further wherein the measure of said horizontal distance is obtained by counting the number of said pulses which occur during said time interval.

15. A method according to claim 14 wherein said number is compared with preset maximum and minimum numbers.

16. A method according to any of claims 13 through 15 wherein the approach of said leading edge is sensed by directing illumination across the path of said container and detecting light-to-dark transitions at said elevations.

* * * * *

UNITED STATES PATENT AND TRADEMARK OFFICE

CERTIFICATE OF CORRECTION

PATENT NO. : 4,259,571

DATED : March 31, 1981

INVENTOR(S) : Gregory T. Dubberly

It is certified that error appears in the above-identified patent and that said Letters Patent are hereby corrected as shown below:

Column 3, line 35, "space" should be --spaced--.

Column 7, line 32, "downwardly" should be --backwardly--.

Signed and Sealed this

*Fourteenth* Day of *July 1981*

[SEAL]

*Attest:*

GERALD J. MOSSINGHOFF

*Attesting Officer*

*Commissioner of Patents and Trademarks*